US011198994B1

(12) United States Patent
Cebull

(10) Patent No.: US 11,198,994 B1
(45) Date of Patent: Dec. 14, 2021

(54) SEPARABLE STRAINER DEVICE FOR A DRAIN

(71) Applicant: Roberto Carlos Cebull, Columbus, OH (US)

(72) Inventor: Roberto Carlos Cebull, Columbus, OH (US)

( * ) Notice: Subject to any disclaimer, the term of this patent is extended or adjusted under 35 U.S.C. 154(b) by 90 days.

(21) Appl. No.: 16/391,645

(22) Filed: Apr. 23, 2019

Related U.S. Application Data

(60) Provisional application No. 62/662,029, filed on Apr. 24, 2018.

(51) Int. Cl.
*E03C 1/26* (2006.01)
*E03C 1/22* (2006.01)

(52) U.S. Cl.
CPC . *E03C 1/26* (2013.01); *E03C 1/22* (2013.01)

(58) Field of Classification Search
CPC ..... A47K 1/14; E03C 1/262; E03C 1/264; E03C 1/282; E03F 5/0408
See application file for complete search history.

(56) References Cited

U.S. PATENT DOCUMENTS 769,001 A 8/1904 Lawrence
1,014,223 A * 1/1912 Hunsicker ..... E03C 1/264 4/291
1,593,087 A * 7/1926 Logan ..... E03C 1/264 4/291
2,075,443 A * 3/1937 Kirschner ..... E03C 1/262 4/287
3,935,602 A 2/1976 Kale
3,959,831 A * 6/1976 Hendricks ..... E03C 1/264 4/287
4,301,554 A 11/1981 Wojcicki
4,932,082 A 6/1990 Ridgeway
5,348,030 A 9/1994 Hirzel
6,088,843 A 7/2000 Francisco
8,011,030 B2 * 9/2011 Li ..... E03C 1/262 4/287
9,499,962 B2 * 11/2016 Joseph ..... E03C 1/262
D785,767 S 5/2017 Karnegie
D794,759 S 8/2017 Karnegie et al.
9,752,306 B2 9/2017 Scamuffa
(Continued)

FOREIGN PATENT DOCUMENTS

WO WO0218719 * 3/2002 ..... E03C 1/264

*Primary Examiner* — David P Angwin
*Assistant Examiner* — Nicholas A Ros
(74) *Attorney, Agent, or Firm* — The Law Office of Patrick F. O'Reilly III, LLC

(57) ABSTRACT

A separable strainer device for a drain is disclosed herein. The separable strainer device includes a first component, the first component including one or more apertures formed therein; and a second component, the second component including one or more teeth configured to engage with the one or more apertures in the first component. The first and second components are configured to fit together so as to form the strainer device for preventing hair and other debris from entering into a drain pipe of the drain. The first and second components also are configured to be dissembled from one another so as to allow at least a substantial portion of the hair and other debris caught by the strainer device to be cleaned from the strainer device without requiring the user to touch the hair and other debris.

19 Claims, 6 Drawing Sheets

(56) References Cited

U.S. PATENT DOCUMENTS

| | | | | |
|---|---|---|---|---|
| 2009/0151060 | A1 | 6/2009 | Zubillaga et al. | |
| 2013/0014336 | A1 | 1/2013 | Bernstein | |
| 2014/0007334 | A1 | 1/2014 | Golibart | |
| 2016/0040412 | A1 | 2/2016 | Fetkovich | |
| 2016/0265204 | A1 | 9/2016 | Zito | |
| 2017/0073948 | A1* | 3/2017 | Terrell ..... | A47K 1/14 |

* cited by examiner

SEPARABLE STRAINER DEVICE FOR A DRAIN

CROSS-REFERENCE TO RELATED APPLICATIONS

This patent application claims priority to, and incorporates by reference in its entirety, U.S. Provisional Patent Application No. 62/662,029, entitled "Separable Strainer Device For A Drain", filed on Apr. 24, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a separable strainer device for a drain. More particularly, the invention relates to a separable strainer device for a drain that is configured to be inserted into the drain so as to prevent hair and other debris from entering into a drain pipe of the drain.

2. Background

Bathtub drains and shower drains frequently become clogged with hair and other debris that prevents the proper drainage of water through these drains. When these drains become clogged, a user typically utilizes a drain unclogging liquid, a plunger, and/or other types of unclogging devices to restore proper fluid flow through these drains. Over time, drain unclogging liquids, which frequently contain harsh chemicals to dissolve accumulated debris, can result in the deterioration of drain pipes that leads to eventual pipe leaks and the consequential repair and/or replacement of the damaged piping.

In order to prevent hair and other debris from going down the drain, conventional hair catcher devices that fit over the drain openings are sometimes used. However, these conventional hair catcher devices have numerous limitations and drawbacks. First of all, these conventional hair catcher devices require manual cleaning by the users thereof, which requires the users to remove the hair and other debris using their fingers, a paper towel, or a napkin. As such, the cleaning of these conventional hair catcher devices is unhygienic and unpleasant for the users. In addition, these conventional hair catcher devices often are not effective at trapping all of the hair and debris before it enters the drain, thus resulting in the eventual clogging of the drain even though a hair stopper is being used.

Therefore, what is needed is a separable strainer device for a drain that is capable of being easily cleaned without requiring a user to manually remove all of the hair and other accumulated debris from the device during the cleaning thereof. Further, a separable strainer device for a drain is needed that effectively traps the vast majority of all hair and other debris before it enters the drain, thereby preventing the clogging of the drain.

BRIEF SUMMARY OF EMBODIMENTS OF THE INVENTION

Accordingly, the present invention is directed to a separable strainer device for a drain that substantially obviates one or more problems resulting from the limitations and deficiencies of the related art.

In accordance with one or more embodiments of the present invention, there is provided a separable strainer device for a drain, which includes a first component, the first component including one or more apertures formed therein; and a second component, the second component including one or more teeth configured to engage with the one or more apertures in the first component. The first and second components are configured to fit together so as to form the strainer device for preventing hair and other debris from entering into a drain pipe of the drain. The first and second components also are configured to be dissembled from one another so as to allow at least a substantial portion of the hair and other debris caught by the strainer device to be cleaned from the strainer device without requiring the user to touch the hair and other debris.

In a further embodiment of the present invention, the first component further comprises a cap portion or ledge portion and a wall portion extending from the cap portion or ledge portion, the one or more apertures being formed in the wall portion of the first component.

In yet a further embodiment, the cap portion comprises a first surface and a second surface oppositely disposed relative to the first surface, the cap portion further comprising a knob extending outwardly from the first surface, the knob configured to facilitate a grasping of the strainer device by the user, and the wall portion extends outwardly from the second surface.

In still a further embodiment, the wall portion of the first component comprises a first side edge and a second side edge oppositely disposed relative to the first side edge, at least one of the first side edge and the second side edge including a notch formed therein.

In yet a further embodiment, the one or more apertures formed in the wall portion of the first component comprise a first plurality of apertures formed in an upper part of the wall portion and a second plurality of apertures formed in a lower part of the wall portion, the second plurality of apertures being offset relative to the first plurality of apertures.

In still a further embodiment, the second component further comprises a wall portion, the one or more teeth of the second component extending outwardly from a side of the wall portion.

In yet a further embodiment, the one or more teeth of the second component comprise a first plurality of teeth extending outwardly from an upper part of the wall portion and a second plurality of teeth extending outwardly from a lower part of the wall portion, the first plurality of teeth being spaced apart from second plurality of teeth by a gap.

In still a further embodiment, the first plurality of teeth of the second component are staggered relative to the second plurality of teeth of the second component.

In yet a further embodiment, the first and second components are circular or semi-circular in shape so as to fit a circular drain opening.

In accordance with yet one or more other embodiments of the present invention, there is provided a separable strainer device for a drain, which includes a first component, the first component including a plurality of apertures formed therein; and a second component, the second component including a plurality of teeth, at least some of the plurality of teeth configured to engage with respective ones of the plurality of apertures in the first component. The first and second components are configured to fit together so as to form the strainer device for preventing hair and other debris from entering into a drain pipe of the drain. The first and second components also are configured to be dissembled from one another so as to allow at least a substantial portion of the hair and other debris caught by the strainer device to be cleaned from the strainer device without requiring the user to touch the hair and other debris.

In a further embodiment of the present invention, the first component further comprises a cap portion or ledge portion and a wall portion extending from the cap portion or ledge portion, the plurality of apertures being formed in the wall portion of the first component.

In yet a further embodiment, the wall portion of the first component comprises a first side edge and a second side edge oppositely disposed relative to the first side edge, at least one of the first side edge and the second side edge including a notch formed therein.

In still a further embodiment, the plurality of apertures formed in the wall portion of the first component comprise a first plurality of apertures formed in an upper part of the wall portion and a second plurality of apertures formed in a lower part of the wall portion, the second plurality of apertures being offset relative to the first plurality of apertures.

In yet a further embodiment, the second component further comprises a wall portion, the plurality of teeth of the second component extending outwardly from a side of the wall portion.

In still a further embodiment, the plurality of teeth of the second component comprise a first plurality of teeth extending outwardly from an upper part of the wall portion and a second plurality of teeth extending outwardly from a lower part of the wall portion, the first plurality of teeth being spaced apart from second plurality of teeth by a gap.

In yet a further embodiment, the first plurality of teeth of the second component are staggered relative to the second plurality of teeth of the second component.

In still a further embodiment, the first and second components are circular or semi-circular in shape so as to fit a circular drain opening.

In yet a further embodiment, the first component further comprises a first ledge portion and a vertical wall portion extending from the first ledge portion, the plurality of apertures being formed in the vertical wall portion of the first component; and the second component further comprises a second ledge portion and a connecting wall portion extending from the second ledge portion, the plurality of teeth of the second component extending outwardly from a side of the connecting wall portion.

In still a further embodiment, when the first and second components are assembled with one another, the connecting wall portion of the second component is disposed adjacent to the vertical wall portion of the first component.

In yet a further embodiment, when the first and second components are assembled with one another, the first ledge portion of the first component is configured to be disposed adjacent to the second ledge portion of the second component.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
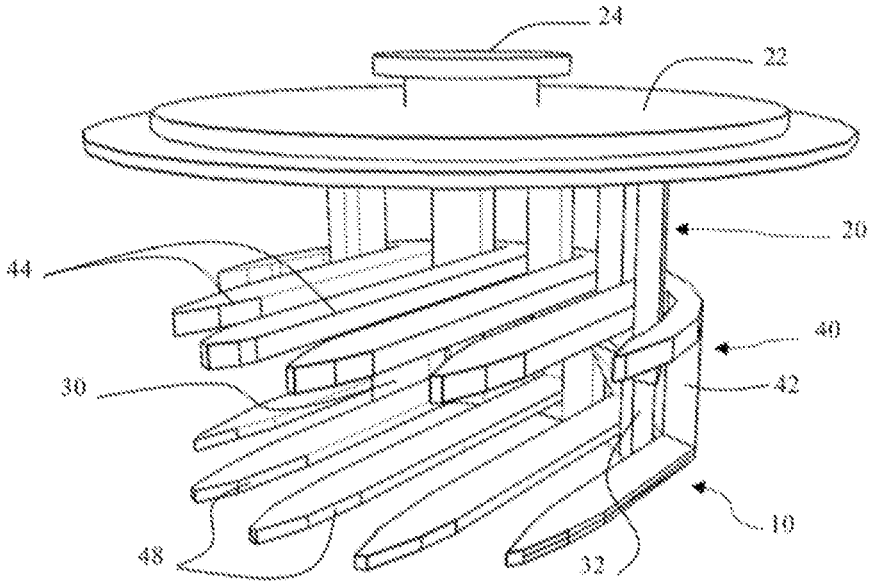
FIG. 1 is a perspective view of a separable strainer device, according to a first illustrative embodiment of the invention, wherein the separable strainer device is shown in its assembled state.

A first illustrative embodiment of a separable strainer device for a drain is seen generally at 10 in FIGS. 1-8. In the first illustrative embodiment, referring initially to FIGS. 1-4, the separable strainer device 10 generally comprises a first component 20, the first component 20 including a plurality of apertures 34, 36 formed therein; and a second component 40, the second component 40 including a plurality of teeth 44, 48, at least some of the plurality of teeth 44, 48 configured to engage with respective ones of the plurality of apertures 34, 36 in the first component 20. The first and second components 20, 40 are configured to fit together so as to form the strainer device 10 for preventing hair and other debris from entering into a drain pipe 16 of a drain (e.g., a drain of bathtub in FIGS. 7 and 8). The first and second components 20, 40 are configured to be dissembled from one another (see FIG. 4) so as to allow at least a substantial portion of the hair and other debris caught by the strainer device 10 to be cleaned from the strainer device 10 without requiring the user to touch the hair and other debris. That is, the hair and other debris simply falls off the strainer device 10 once the two components 20, 40 are disassembled from one another. As such, the user can easily dispose of the hair and other debris without touching the hair and other debris.

Figure 5:
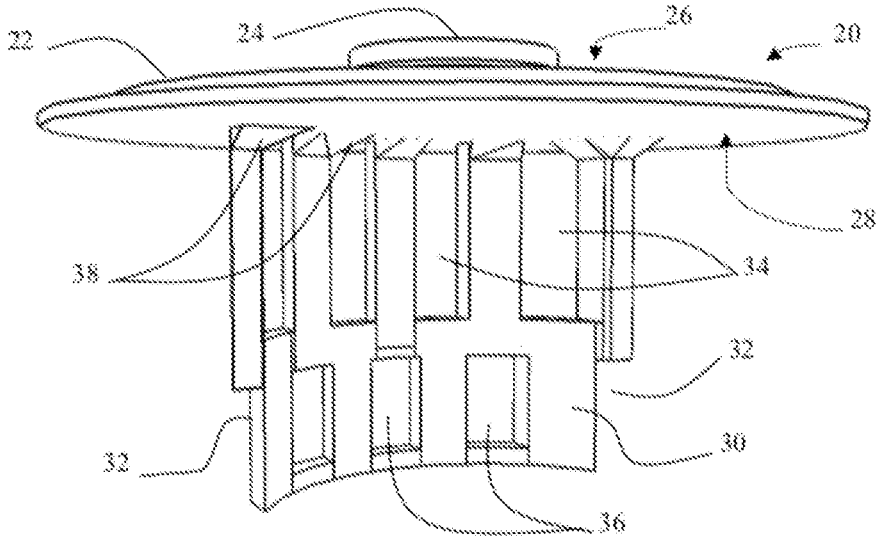
FIG. 5 is a perspective view of the first component of the separable strainer device of FIG. 1.

Now, referring primarily to FIG. 5, the first component 20 of the illustrative separable strainer device 10 will be described. Initially, as shown in FIG. 5, the first component or the separator component 20 generally comprises a cap portion 22 and a vertical wall portion 30 extending downwardly from the cap portion 22. In FIG. 5, it can be seen that the plurality of apertures 34, 36 are formed in the vertical wall portion 30 of the first component 20. In the illustrative embodiment, the cap portion 22 comprises a first top surface 26 and a second bottom surface 28 oppositely disposed relative to the first top surface 26. The cap portion 22 further comprising a knob 24 extending upwardly from the first top surface 26. The knob 24 is configured to facilitate a grasping of the strainer device 10 by the user. In the illustrative embodiment, the vertical wall portion 30 extends downwardly from the second bottom surface 28 of the cap portion 22. In order to strengthen the connection between the vertical wall portion 30 and the cap portion 22, in the illustrative embodiment, chamfered corners 38 are provided at the top of the vertical wall portion 30 where the vertical wall portion 30 is joined to the cap portion 22 (see FIG. 5).

Figure 4:
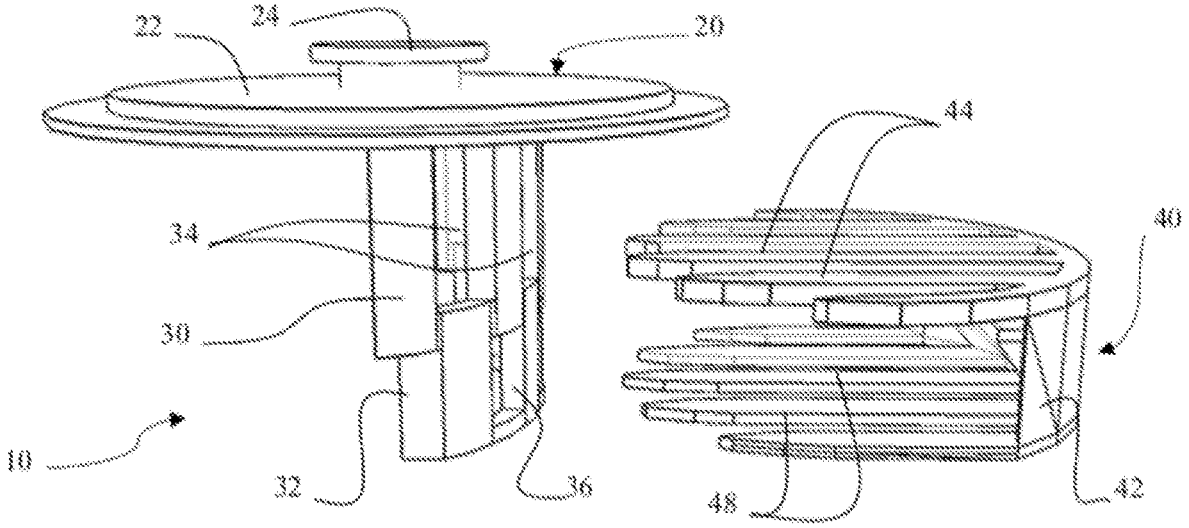
FIG. 4 is another perspective view of the separable strainer device of FIG. 1, wherein the components of the separable strainer device are shown disassembled from one another.

Referring again to the illustrative embodiment depicted in FIGS. 4 and 5, it can be seen that the vertical wall portion 30 of the first component 20 comprises a first side edge and a second side edge oppositely disposed relative to the first side edge. Each of the first and second side edges have a respective notch 32 formed therein. As best shown in the assembled front view of FIG. 2, each tooth of the outermost pair of lower teeth 48 of the second component 40 is disposed in a respective one of the oppositely disposed notches 32 of vertical wall portion 30. The notches 32 allow the outermost pair of lower teeth 48 of the second component 40, which are offset relative upper teeth 44, to protrude through the vertical wall portion 30 of the first component 20. In the illustrative embodiment, the plurality of apertures 34, 36 formed in the vertical wall portion 30 of the first component 20 comprise a first plurality of elongate apertures or slots 34 formed in an upper part of the vertical wall portion 30 and a second plurality of elongate apertures or slots 36 formed in a lower part of the vertical wall portion 30 (refer to FIG. 5). The second plurality of elongate apertures 36 are offset relative to the first plurality of elongate apertures 34, and the second plurality of elongate apertures 36 are shorter in length than the first plurality of elongate apertures 34. The elongate apertures 34, 36 are separated from one another by elongate columns (see FIG. 5). The two rows of columns of the first component 20, which are disposed between the respective upper and lower elongate apertures 34, 36, are offset from one another in order to allow for the second component 40 to fit through the apertures 34, 36 of the first component 20.

Figure 6:
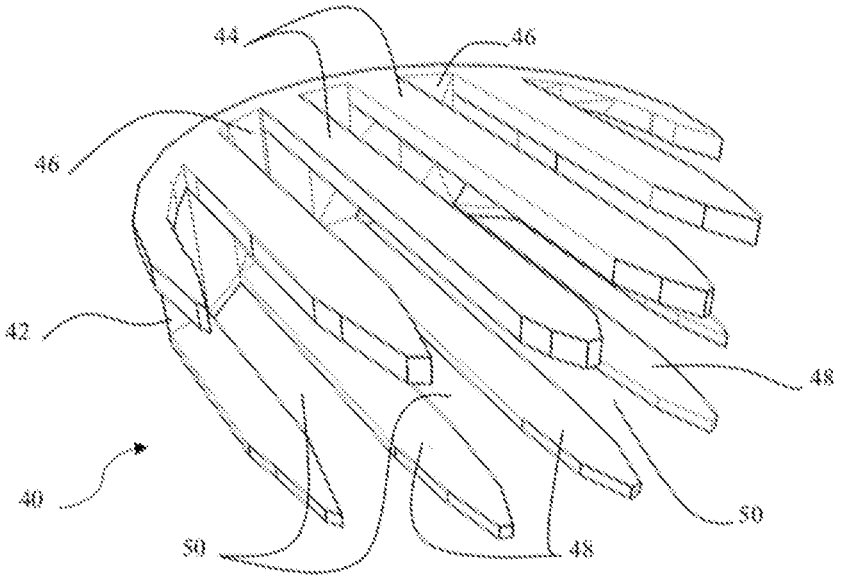
FIG. 6 is a perspective view of the second component of the separable strainer device of FIG. 1.

Next, with particular reference to FIG. 6, the second component 40 of the illustrative separable strainer device 10 will be explained. Initially, as shown in FIG. 6, the second component or the strainer component 40 generally comprises a vertical wall portion 42 and a plurality of teeth 44, 48 extending outwardly from a side of the vertical wall portion 42. In the illustrative embodiment, the plurality of teeth 44, 48 of the second component 40 comprise a first plurality of elongate teeth 44 extending outwardly from an upper part of the vertical wall portion 42 and a second plurality of elongate teeth 48 extending outwardly from a lower part of the vertical wall portion 42. As best shown in FIG. 6, the upper teeth 44 of the second component 40 are separated from one another by elongate horizontal gaps 46, while the lower teeth 48 of the second component 40 are separated from one another by elongate horizontal gaps 50. Also, the two rows of protruding teeth 44, 48 are vertically spaced apart from another by a vertical gap (see FIG. 6). In addition, in the illustrative embodiment, the first plurality of elongate teeth 44 of the second component 40 are staggered relative to the second plurality of elongate teeth 48 of the second component 40 so that the teeth 44, 48 are capable of being received within the offset apertures 34, 36 of the first component 20. As shown in the assembled views of FIGS. 1 and 2, the upper teeth 44 of the second component 40 are received within the upper apertures 34 of the first component 20, while the lower teeth 48 of the second component 40 are received within the lower apertures 36 of the first component 20. Also, as shown in these figures, when the first and second components 20, 40 are assembled with one another, the vertical wall portion 42 of the second component 40 is disposed adjacent to the vertical wall portion 30 of the first component 20 (i.e., the vertical wall portion 42 of the second component 40 abuts the vertical wall portion 30 of the first component 20—see FIGS. 1 and 2).

Figure 2:
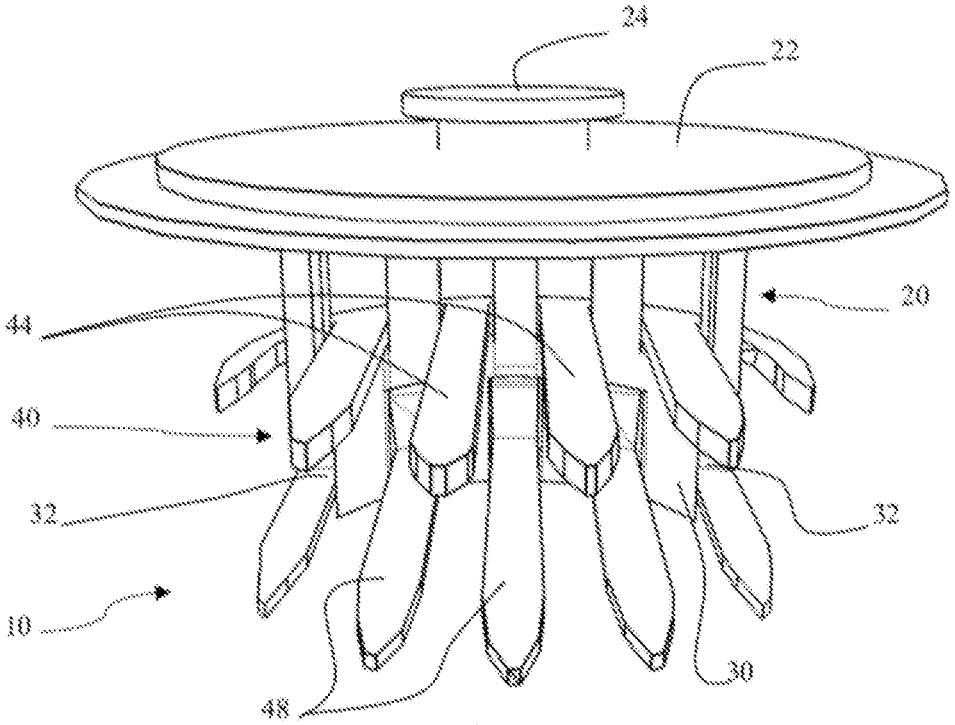
FIG. 2 is a front view of the separable strainer device of FIG. 1.
Figure 3:
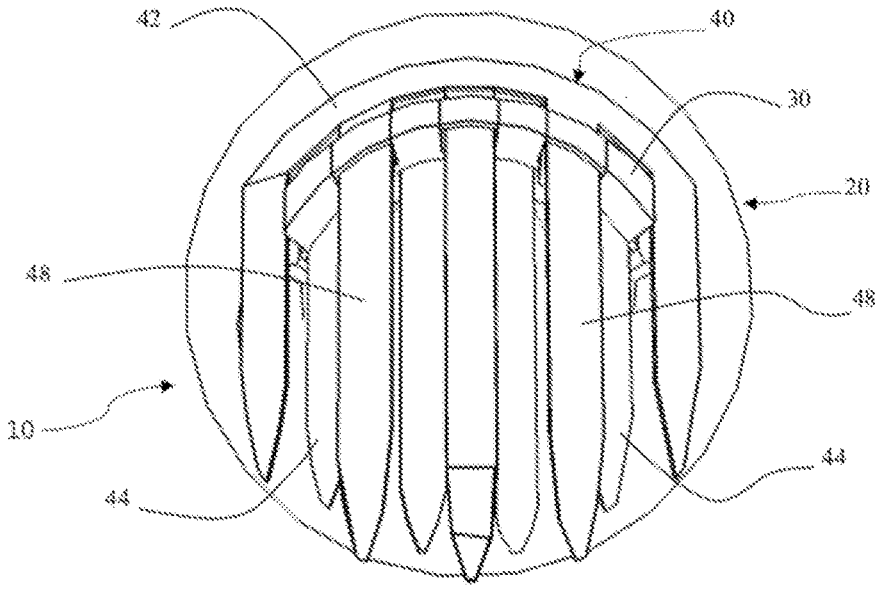
FIG. 3 is a bottom view of the separable strainer device of FIG. 1.

In the illustrative embodiment, with reference to FIGS. 1 and 2, the first and second components 20, 40 of the strainer device 10 may be circular or semi-circular in shape so as to fit a circular drain opening. Also, in the illustrative embodiment, the first component or separator component 20 may have an overall height of approximately 1.5 inches (approximately 38.1 millimeters) and a width or diameter of approximately 2.5 inches (approximately 63.5 millimeters) at the cap portion 22 of the first component 20. Further, in the illustrative embodiment, the second component or strainer component 40 may have an overall height of approximately 0.5 inches (approximately 12.7 millimeters) and a width or diameter of approximately 1.75 inches (approximately 44.45 millimeters) at the longest tooth. In other embodiments of the invention, the components 20, 40 of the strainer device 10 may have other suitable shapes and dimensions for adapting to a particular application.

Figure 7:
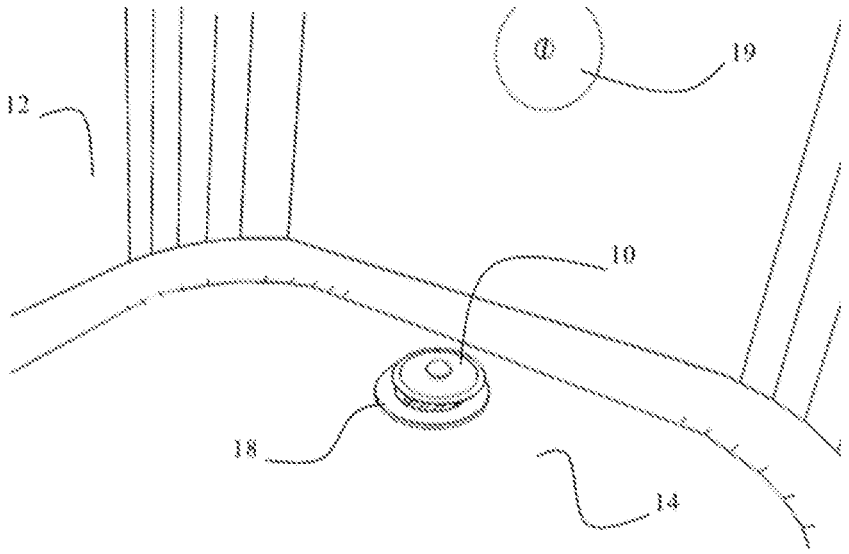
FIG. 7 is a perspective view of the separable strainer device of FIG. 1 disposed in the drain of a bathtub.
Figure 8:
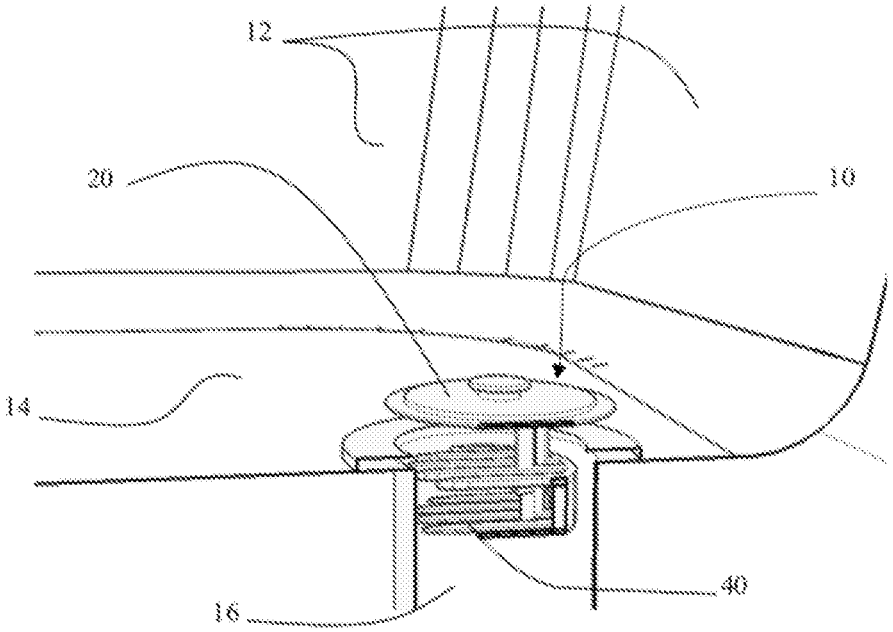
FIG. 8 is a cut-away perspective view of the separable strainer device of FIG. 1 disposed in the drain of a bathtub.

Now, referring to FIGS. 7 and 8, an illustrative application for the separable strainer device 10 will be described. In FIGS. 7 and 8, the strainer device 10 has been inserted into a bathtub drain to prevent hair and other debris from entering the drain pipe 16 of the drain, thus preventing the clogging of the drain pipe 16. In FIGS. 7 and 8, it can be seen that the bathtub comprises bathtub walls 12 and a bathtub floor 14. The drain of the bathtub is provided in the floor 14 of the bathtub and comprises a peripheral drain rim 18 disposed therearound. Also, it can be seen that the bathtub further comprises an overflow drain 19, which functions as a secondary drain for draining water from the bathtub in the event that primary drain becomes blocked. As best shown in the cut-away perspective view of FIG. 8, in the installed state, the second component 40 of the strainer device 10 is inserted down into the drain pipe 16 to prevent hair and other debris from entering the drain pipe 16, while the cap portion 22 of the first component 20 is disposed above the top of the drain. As shown in FIG. 8, it can be seen that both components 20, 40 of the strainer device 10 fit together and sit inside the drain hole. While the two-part strainer device 10 is shown being used in conjunction with a bathtub in FIGS.

7 and 8, it is to be understood that the strainer device 10 may be used in many other applications, such as in shower drains and sink drains.

Figure 9:
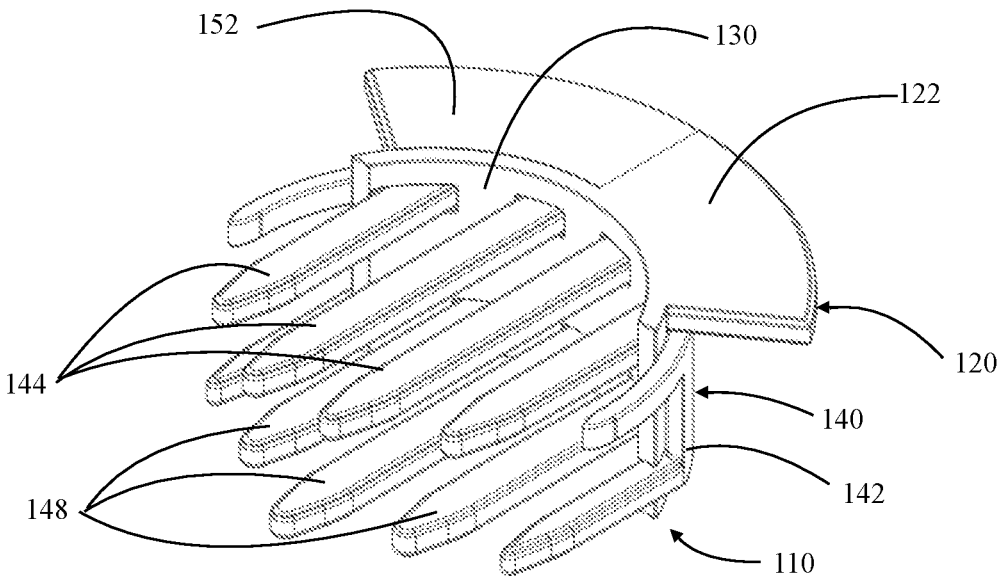
FIG. 9 is a perspective view of a separable strainer device, according to a second illustrative embodiment of the invention, wherein the separable strainer device is shown in its assembled state.
Figure 10:
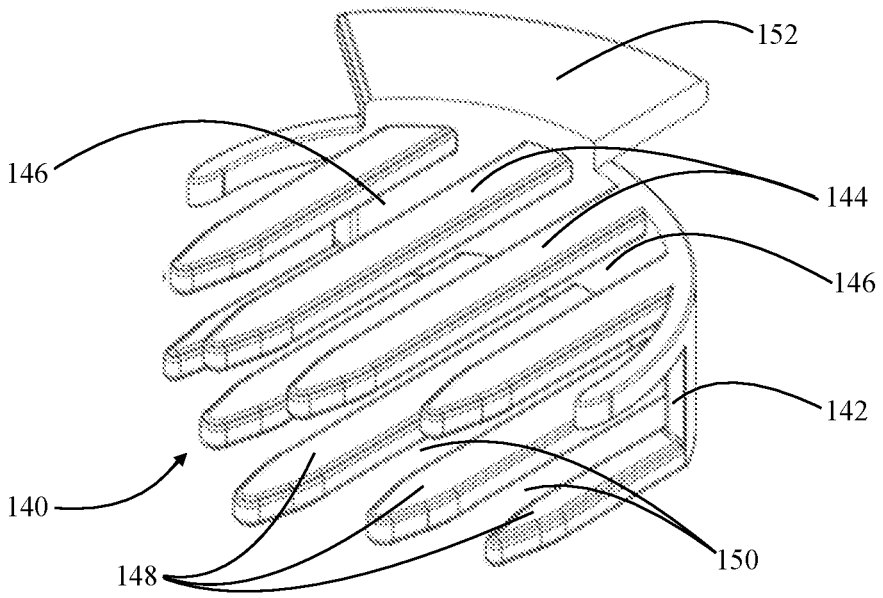
FIG. 10 is a perspective view of the second component of the separable strainer device of FIG. 9.
Figure 11:
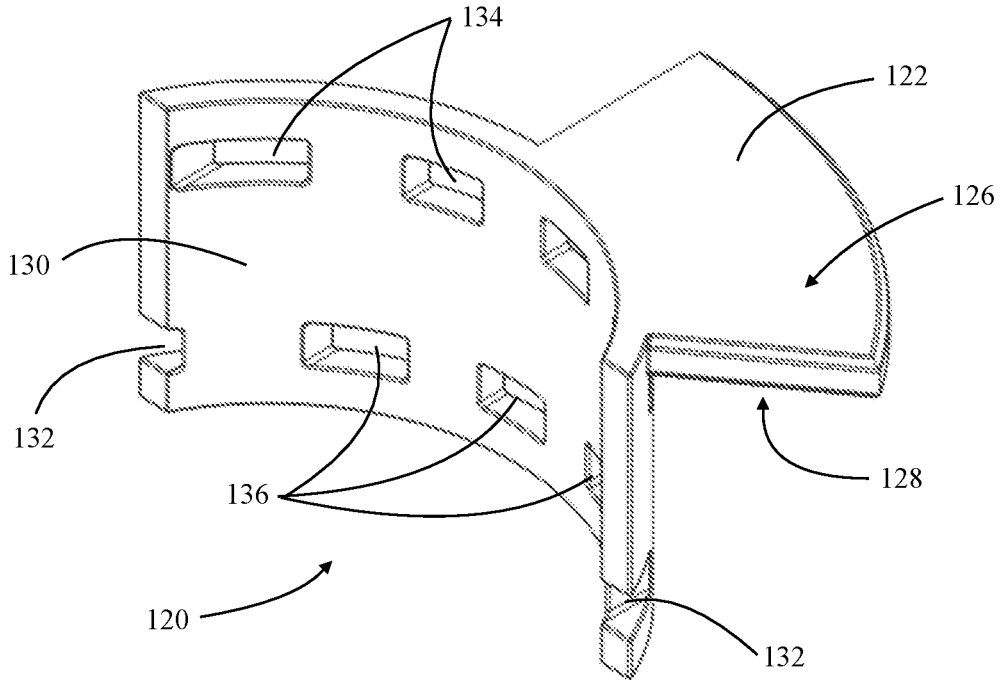
FIG. 11 is a perspective view of the first component of the separable strainer device of FIG. 9.

A second illustrative embodiment of the separable strainer device for a drain is seen generally at 110 in FIGS. 9-11. Referring to these figures, it can be seen that, in many respects, the illustrative embodiment of FIGS. 9-11 is similar to the illustrative embodiment described above. Moreover, many elements are common to both such embodiments. For the sake of brevity, the elements that the embodiment of FIGS. 9-11 has in common with the embodiment of FIGS. 1-8 will not be discussed in detail because these components have already been explained above.

The separable strainer device 110 of FIGS. 9-11 is generally similar to that of FIGS. 1-8 described above, except that the top portion of the separable strainer device 110 is different than the separable strainer device 10 described above. Similar to the first illustrative embodiment, referring collectively to FIGS. 9-11, the separable strainer device 110 generally comprises a first component 120, the first component 120 including a plurality of apertures 134, 136 formed therein; and a second component 140, the second component 140 including a plurality of teeth 144, 148, at least some of the plurality of teeth 144, 148 configured to engage with respective ones of the plurality of apertures 134, 136 in the first component 120. The first and second components 120, 140 are configured to fit together so as to form the strainer device 110 for preventing hair and other debris from entering into a drain pipe 16 of a drain (e.g., a drain of bathtub in FIGS. 7 and 8). Similar to the first illustrative embodiment, the first and second components 120, 140 are configured to be dissembled from one another so as to allow at least a substantial portion of the hair and other debris caught by the strainer device 110 to be cleaned from the strainer device 110 without requiring the user to touch the hair and other debris. That is, the hair and other debris simply falls off the strainer device 110 once the two components 120, 140 are disassembled from one another. As such, the user can easily dispose of the hair and other debris without touching the hair and other debris.

Now, referring primarily to FIG. 11, the first component 120 of the illustrative separable strainer device 110 will be described. Initially, as shown in FIG. 11, the first component or the separator component 120 generally comprises a top ledge portion 122 and a vertical wall portion 130 extending downwardly from the top ledge portion 122. In FIG. 11, it can be seen that the plurality of apertures 134, 136 are formed in the vertical wall portion 130 of the first component 120. In the illustrative embodiment, the top ledge portion 122 comprises a first top surface 126 and a second bottom surface 128 oppositely disposed relative to the first top surface 126. In the illustrative embodiment, the vertical wall portion 130 extends downwardly from the second bottom surface 128 of the top ledge portion 122.

Referring again to the illustrative embodiment depicted in FIG. 11, it can be seen that the vertical wall portion 130 of the first component 120 comprises a first side edge and a second side edge oppositely disposed relative to the first side edge. Each of the first and second side edges have a respective notch 132 formed therein. As best shown in the assembled perspective view of FIG. 9, each tooth of the outermost pair of lower teeth 148 of the second component 140 is disposed in a respective one of the oppositely disposed notches 132 of vertical wall portion 130. The notches 132 allow the outermost pair of lower teeth 148 of the second component 140 to protrude through the vertical wall portion 130 of the first component 120. In the illustrative embodiment, the plurality of apertures 134, 136 formed in the vertical wall portion 130 of the first component 120 comprise a first plurality of elongate apertures or slots 134 formed in an upper part of the vertical wall portion 130 and a second plurality of elongate apertures or slots 136 formed in a lower part of the vertical wall portion 130 (refer to FIG. 11). The second plurality of elongate apertures 136 are offset relative to the first plurality of elongate apertures 134.

Next, with particular reference to FIG. 10, the second component 140 of the illustrative separable strainer device 110 will be explained. Initially, as shown in FIG. 10, the second component or the strainer component 140 generally comprises a top ledge portion 152, a vertical wall portion 142, and a plurality of teeth 144, 148 extending outwardly from a side of the vertical wall portion 142. In the illustrative embodiment, the vertical wall portion 142 extends downwardly from the bottom surface of the top ledge portion 152. In the illustrative embodiment, the plurality of teeth 144, 148 of the second component 140 comprise a first plurality of elongate teeth 144 extending outwardly from an upper part of the vertical wall portion 142 and a second plurality of elongate teeth 148 extending outwardly from a lower part of the vertical wall portion 142. As best shown in FIG. 10, the upper teeth 144 of the second component 140 are separated from one another by elongate horizontal gaps 146, while the lower teeth 148 of the second component 140 are separated from one another by elongate horizontal gaps 150. Also, the two rows of protruding teeth 144, 148 are vertically spaced apart from another by a vertical gap (see FIG. 10). In addition, in the illustrative embodiment, the first plurality of elongate teeth 144 of the second component 140 are staggered relative to the second plurality of elongate teeth 148 of the second component 140 so that the teeth 144, 148 are capable of being received within the offset apertures 134, 136 of the first component 120. As shown in the assembled perspective view of FIG. 9, the upper teeth 144 of the second component 140 are received within the upper apertures 134 of the first component 120, while the lower teeth 148 of the second component 140 are received within the lower apertures 136 of the first component 120. Also, as shown in this figure, when the first and second components 120, 140 are assembled with one another, the vertical wall portion 142 of the second component 140 is disposed adjacent to the vertical wall portion 130 of the first component 120 (i.e., the vertical wall portion 142 of the second component 140 abuts the vertical wall portion 130 of the first component 120—see FIG. 9).

As described above, each of the first and second components 120, 140 of the illustrative separable strainer device 110 has a respective top ledge portion 122, 152. When the separable strainer device 110 has been inserted into a bathtub drain (e.g., in the drain of the bathtub in FIGS. 7 and 8), the top ledge portions 122, 152 of the first and second components 120, 140 rest on the drain edge so that the separable strainer device 110 does not fall into the drain. As shown in the assembled perspective view of FIG. 9, when the first and second components 120, 140 are assembled with one another, the first ledge portion 122 of the first component 120 is configured to be disposed adjacent to the second ledge portion 152 of the second component 140. In the illustrative embodiment, the split ledge construction of the separable strainer device 110 also advantageously makes it more intuitive for the user to assemble the two components 120, 140 back together after separation for cleaning. That is, to assemble two components 120, 140 back together, the user inserts the second component 140 into the first component 120 until the first and second ledge portions 122, 152 are disposed adjacent to one another. As such, it becomes clearly evident to the user how the two components 120, 140 are assembled back together after cleaning.

It is readily apparent that the aforedescribed separable strainer device 10, 110 offers numerous advantages. First, the separable strainer device 10, 110 is capable of being easily cleaned without requiring a user to manually remove all of the hair and other accumulated debris from the device during the cleaning thereof. Rather, the hair and other accumulated debris can be removed from the strainer device 10, 110 simply by separating the two components 120, 140 from one another, which loosens and dislodges the trapped hair and other debris. That is, once the hair and debris is caught in the strainer device 10, 110, the device is removed from the drain, and when both components 20, 40 or 120, 140 are separated from another, the hair and debris slide off due to the separation of the components. As such, little or no hair and other debris have to be pulled off by hand for the cleaning of the device. Secondly, the aforedescribed separable strainer device 10, 110 effectively traps the vast majority of all hair and other debris before it enters the drain, thereby preventing the clogging of the drain. As described above, the second component 40, 140 of the strainer device 10, 110 has two rows of offset teeth 44, 48 or 144, 148 so that if hair and/or debris fall through the gaps 46, 146 in the top row of teeth 44, 144, the hair and/or debris will likely be caught by the bottom row of teeth 48, 148.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A separable strainer device for a drain, comprising:

a first component, said first component including one or more apertures formed therein, said one or more apertures extending through said first component from a first surface of said first component to a second surface of said first component, said first surface of said first component being oppositely disposed relative to said second surface of said first component; and a second component, said second component including one or more teeth configured to engage with said one or more apertures in said first component, said second component further comprising a wall portion, said one or more teeth of said second component extending outwardly from a side of said wall portion;

wherein said first and second components are configured to fit together so as to form said strainer device for preventing hair and other debris from entering into a drain pipe of said drain, said first and second components configured to be disassembled from one another so as to allow a portion of said hair and other debris caught by said strainer device to be cleaned from said strainer device without requiring said user to touch said hair and other debris;

wherein said one or more teeth of said second component comprise a first plurality of teeth extending outwardly from an upper part of said wall portion and a second plurality of teeth extending outwardly from a lower part of said wall portion, said first plurality of teeth being spaced apart from said second plurality of teeth by a gap.

2. The separable strainer device according to claim 1, wherein said first plurality of teeth of said second component are staggered relative to said second plurality of teeth of said second component.

3. The separable strainer device according to claim 1, wherein said first and second components are circular or semi-circular in shape so as to fit a circular drain opening.

4. The separable strainer device according to claim 1, wherein said first component further comprises a cap portion or ledge portion and a wall portion extending from said cap portion or ledge portion, said one or more apertures being formed in said wall portion of said first component.

5. The separable strainer device according to claim 4, wherein said cap portion comprises a first cap surface and a second cap surface oppositely disposed relative to said first cap surface, said cap portion further comprising a knob extending outwardly from said first cap surface, said knob configured to facilitate a grasping of said strainer device by said user, and wherein said wall portion extends outwardly from said second cap surface.

6. The separable strainer device according to claim 4, wherein said wall portion of said first component comprises a first side edge and a second side edge oppositely disposed relative to said first side edge, at least one of said first side edge and said second side edge including a notch formed therein.

7. The separable strainer device according to claim 4, wherein said one or more apertures formed in said wall portion of said first component comprise a first plurality of apertures formed in an upper part of said wall portion and a second plurality of apertures formed in a lower part of said wall portion, said second plurality of apertures being offset relative to said first plurality of apertures.

8. A separable strainer device for a drain, comprising:

a first component, said first component including a plurality of apertures formed therein, said first component further comprising a cap portion or ledge portion and a wall portion extending from said cap portion or ledge portion, said wall portion having a first surface and a second surface oppositely disposed relative to said first surface, said plurality of apertures being formed in said wall portion of said first component, said plurality of apertures extending through said wall portion from said first surface to said second surface, said wall portion of said first component comprising a first side edge and a second side edge oppositely disposed relative to said first side edge, at least one of said first side edge and said second side edge including a notch formed therein; and a second component, said second component including a plurality of teeth, at least some of said plurality of teeth configured to engage with respective ones of said plurality of apertures in said first component;

wherein said first and second components are configured to fit together so as to form said strainer device for preventing hair and other debris from entering into a drain pipe of said drain, said first and second components configured to be disassembled from one another so as to allow a portion of said hair and other debris caught by said strainer device to be cleaned from said strainer device without requiring said user to touch said hair and other debris.

9. The separable strainer device according to claim 8, wherein said plurality of apertures formed in said wall portion of said first component comprise a first plurality of apertures formed in an upper part of said wall portion and a second plurality of apertures formed in a lower part of said wall portion, said second plurality of apertures being offset relative to said first plurality of apertures.

10. The separable strainer device according to claim 8, wherein said first and second components are circular or semi-circular in shape so as to fit a circular drain opening.

11. The separable strainer device according to claim 8, wherein said second component further comprises a wall portion, said plurality of teeth of said second component extending outwardly from a side of said wall portion.

12. The separable strainer device according to claim 11, wherein said plurality of teeth of said second component comprise a first plurality of teeth extending outwardly from an upper part of said wall portion and a second plurality of teeth extending outwardly from a lower part of said wall portion, said first plurality of teeth being spaced apart from said second plurality of teeth by a gap.

13. The separable strainer device according to claim 12, wherein said first plurality of teeth of said second component are staggered relative to said second plurality of teeth of said second component.

14. The separable strainer device according to claim 8, wherein said first component further comprises a first ledge portion, and said wall portion of said first component comprises a vertical wall portion extending from said first ledge portion, said plurality of apertures being formed in said vertical wall portion of said first component; and wherein said second component further comprises a second ledge portion and a connecting wall portion extending from said second ledge portion, said plurality of teeth of said second component extending outwardly from a side of said connecting wall portion.

15. The separable strainer device according to claim 14, wherein, when said first and second components are assembled with one another, said connecting wall portion of said second component is disposed adjacent to said vertical wall portion of said first component.

16. The separable strainer device according to claim 14, wherein, when said first and second components are assembled with one another, said first ledge portion of said first component is configured to be disposed adjacent to said second ledge portion of said second component.

17. A separable strainer device for a drain, comprising:

a first component, said first component including one or more apertures formed therein, said one or more apertures extending through said first component from a first surface of said first component to a second surface of said first component, said first surface of said first component being oppositely disposed relative to said second surface of said first component; and a second component, said second component including one or more teeth configured to engage with said one or more apertures in said first component, said one or more teeth of said second component configured to catch hair and other debris so as to prevent said hair and other debris from entering into a drain pipe of said drain, said second component further comprising a wall portion, said one or more teeth of said second component extending outwardly from a side of said wall portion;

wherein said first and second components are configured to fit together so as to form said strainer device; and wherein, when said first component is disassembled from said second component, a portion of said hair and other debris caught by said one or more teeth of said second component is dislodged from said strainer device without requiring said user to touch said hair and other debris.

18. The separable strainer device according to claim 17, wherein said one or more teeth of said second component comprise a first plurality of teeth extending outwardly from an upper part of said wall portion and a second plurality of teeth extending outwardly from a lower part of said wall portion, said first plurality of teeth being spaced apart from said second plurality of teeth by a gap.

19. The separable strainer device according to claim 18, wherein said first plurality of teeth of said second component are staggered relative to said second plurality of teeth of said second component.

* * * * *